United States Patent [19]

Bell

[11] 4,195,732

[45] Apr. 1, 1980

[54] SUPPORTING AND SPACING MEMBER FOR WEB MATERIAL ROLLS

[75] Inventor: Norman H. Bell, Hortonville, Wis.

[73] Assignees: Great Northern Corporation; Presto Products, Inc., both of Appleton, Wis.

[21] Appl. No.: 882,254

[22] Filed: Feb. 28, 1978

[51] Int. Cl.[2] ..... B65D 85/67; B65D 85/62; B65D 81/06; B65D 19/44

[52] U.S. Cl. ..... 206/391; 206/386; 206/593; 206/443; 206/597; 206/821; 428/542

[58] Field of Search ..... 214/8, 10.5 R, DIG. 3, 214/DIG. 4; 105/367, 489, 490; 206/391, 393, 413, 419, 386, 597, 821, 593; 428/542; 414/910, 911

[56] References Cited

U.S. PATENT DOCUMENTS

| | | | |
|---|---|---|---|
| 2,248,119 | 7/1941 | Reed et al. | 105/367 |
| 2,838,173 | 6/1958 | Emery | 206/419 |
| 2,990,951 | 7/1961 | Fallert | 206/597 |
| 3,403,780 | 10/1968 | Binkley et al. | 206/597 |
| 3,708,084 | 1/1973 | Bixler et al. | 206/419 X |
| 3,837,560 | 9/1974 | Kuchuris et al. | 229/15 |
| 4,008,916 | 2/1977 | Ide | 214/10.5 R X |

FOREIGN PATENT DOCUMENTS

| | | | |
|---|---|---|---|
| 1392563 | 2/1965 | France | 214/10.5 R |

*Primary Examiner*—L. J. Paperner

*Attorney, Agent, or Firm*—Andrus, Sceales, Starke & Sawall

[57] ABSTRACT

A member for protectively supporting and spacing a plurality of rolls of web material such as cellophane in a multi-layer stack is formed as an elongated bar. The bar has a plurality of spaced indentations along at least one elongated surface for receiving the rolls of the stack. The bar is formed with sufficient flexibility to permit a limited, relative movement among the rolls of the stack. This provides a high degree of protection to the rolls. At the same time, the bar has sufficient strength to prevent crushing of the stack. The bar may be formed of expanded polystyrene foam and, preferably, is formed to embrace the ends of the rolls for protective purposes.

4 Claims, 7 Drawing Figures

SUPPORTING AND SPACING MEMBER FOR WEB MATERIAL ROLLS

BACKGROUND OF THE INVENTION

1. Field of the Invention

The present invention relates to spacer type article handling apparatus for rolls of web material.

2. Description of the Prior Art

Web material is commonly stored and transported in rolls because of compactness, avoidance of creases in the web, and ease of application to automatic web handling equipment upon use. While possessing numerous advantages, such rolls exhibit certain disadvantages, particularly in transporting the material. The rolls have a propensity for movement if laid on their side and to tip if stood on their ends. It is difficult to combine a plurality of rolls for bulk shipment on a pallet or other shipping equipment.

The problem is particulary acute in certain types of web materials, including relatively brittle materials such as cellophane, which require a high degree of protection during shipment. Failure to properly protect these materials may result in the web becoming torn or the edge of the roll becoming nicked during transport and handling. Should this occur, the web will tear when tension is applied during subsequent processing and use of the material. End nicks are particularly acute since they tend to be radial in occurrence, causing repeated tearing along the length of the web that often renders the whole roll unuseable. If the rolls become crushed during shipment, the resulting-out-of round condition may create difficulty in mating the core of the roll to the automatic web unwinding machinery.

To obviate the foregoing problems, the prior art has typically employed complex and expensive techniques. U.S. Pat. No. 3,593,861 to Holland, Jr. discloses one such approach. In that patent, individual packaging is provided for each roll and/or special cores are employed to space the packages or rolls from each other and to key them together into a stack.

SUMMARY OF THE PRESENT INVENTION

It is, therefore, the object of the present invention to provide an improved means for handling rolls of web material, in an economicl and highly protective fashion. The invention is particularly suited for brittle materials such as cellophane, and to the storage and transport of such rolls when in a multi-layer stack.

The means comprises an elongated bar having a plurality of spaced indentations along at least one of the elongated surfaces. The indentations are suitable for receiving the rolls of material. The thickness of the bar adjacent the bottom of the indentations provides sufficient space to protect the rolls. The width of the bar, with respect to its height, provides a self-stabilizing property which prevent tipping. The bar is formed of a material of sufficient flexibility to permit limited relative movement among the rolls of the stack while at the same time being of sufficient strength to prevent crushing of the stack. Expanded polystyrene foam is suitable for use in the supporting and spacing members of the present invention.

The elongated bars are placed between the rolls and materials handling apparatus such as a pallet, between the various layers of the stack, and on top of the stack.

The stack may be strapped to the pallet or covered with plastic film.

DETAILED DESCRIPTION OF THE PREFERRED EMBODIMENT

Figure 1:
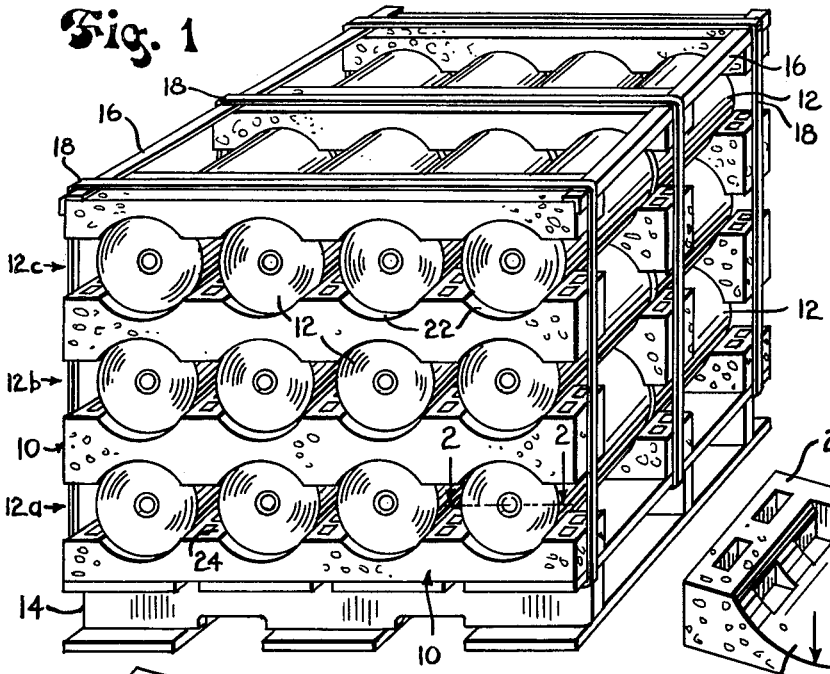
FIG. 1 is a perspective view of a multi-layer stack of rolls on a pallet employing supporting and spacing members of the present invention.

In the FIGURES, the supporting and spacing member of the present invention is identified by the numeral 10. Member 10 is designed to support and space a plurality of rolls 12 of web material, including brittle material such as cellophane, on material handling equipment shown as pallet 14. Rolls 12 are typically stacked in layers on pallet 14, such as layers 12*a*, 12*b*, and 12*c* and supporting and spacing members 10 are placed beneath lower most layer 12*a*, between the lower most layer 12*a* and intermediate layer 12*b*, between intermediate layer 12*b* and uppermost layer 12*c*, and on top of uppermost layer 12*c*. Edge strips 16 are applied to the members 10 on top of the stack and the stack secured to pallet 14 by strapping 18.

Figure 3:
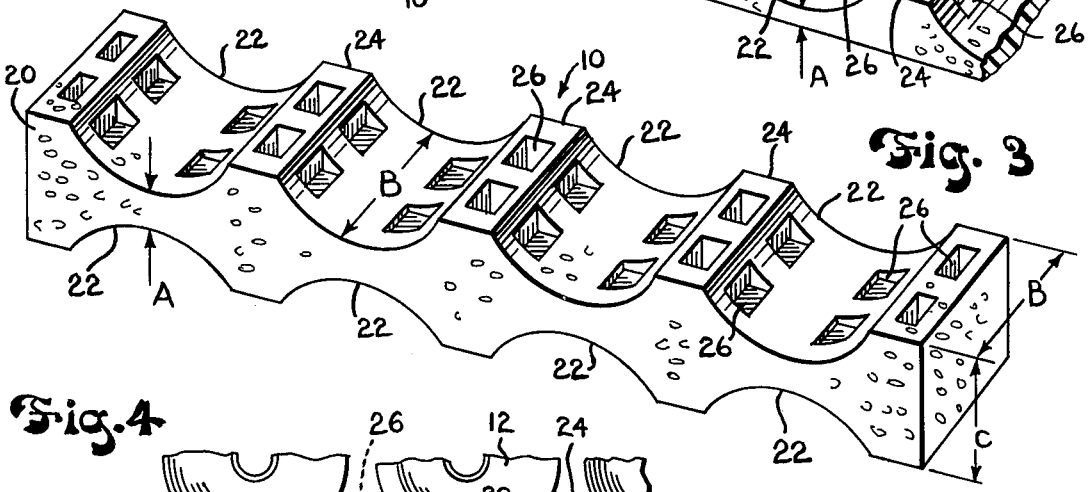
FIG. 3 is a perspective view of a supporting and retaining member constructed in accordance with the present invention.

As shown in FIG. 3, supporting and spacing member 10 is formed as an elongated bar 20. A plurality of spaced indentations 22 are provided in bar 16 which are separated by lands 24. In supporting and spacing members 10 designed for use with intermediate layers of rolls 12, two opposing surfaces of bar 20 contain the spaced indentations. In supporting and spacing member 10 used in conjuction with the upper and lower layers of rolls, only one surface contains indentations 22.

Figure 6:
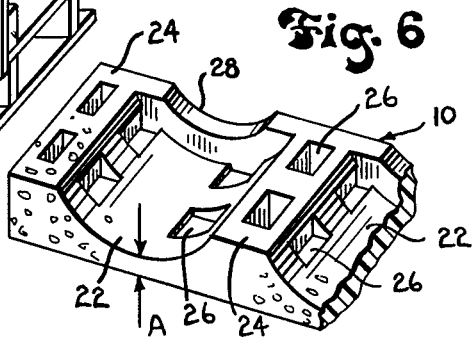
FIG. 6 is a fragmentary perspective view of another embodiment of the supporting and spacing member of the present invention.

The thickness of bar 20 at the bottom of two opposing indentations 22 is such as to space the rolls from each other of from pallet 14 a distance sufficient to provide the necessary protection to rolls 12. This distance, shown as A in FIGS. 3 and 6 is typically one inch. The depth of indentations 22 is sufficient to properly support and retain rolls 12. This is typically two inches of depth from the plane of lands 24 to the bottom of indentations 22. The width of bar 20 is sufficient to render bar 20 self stabilized with respect to the height of bar 20 to prevent tipping of member 10 when placed on rolls 12. Bar 20 may typically be approximately 6 inches wide, dimension B in FIG. 3, and 5 inches high, dimension C in FIG. 3.

In order to provide the adequate support to rolls 12 while at the same time providing the necessary protection, it is essential to form member 10 from a material having sufficient strength to provide such support and to prevent crushing or collapse of the rolls, while, at the same time, having sufficient flexibility to provide protection in the form of limited relative movement among the rolls. These unique requirements may be met by molding member 10 from expanded polystyrene beads. Bar 20 should for optimum functioning have a density in a range of 1 ½ to 2 lbs/cu ft, a compressive strength of 20 psi, for the 1 ½ lbs/cu ft density material to 30 psi for the 2 lbs/cu ft density material and with no less than 5% compressive deformation set per thousand hours in a static bond. The impact strength of the bar should also have sufficient energy absorption capacity to cushion against normal commercial handling in storage and transportation and would be readily understood by those in this art. The flexibility of the material of bar 10 also assists in mating member 10 to rolls 12 of different sizes.

Figure 4:
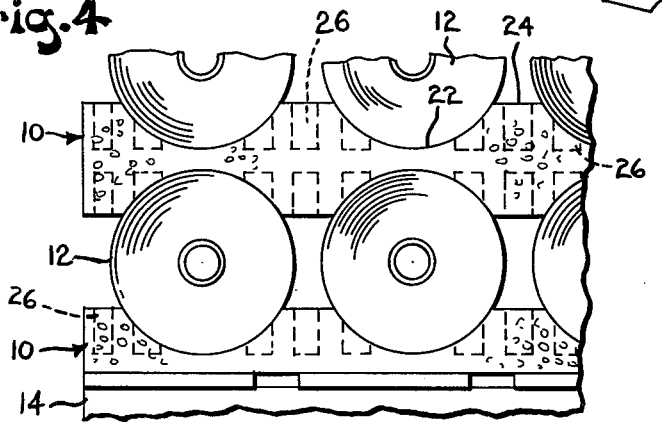
FIG. 4 is a partial view of the supporting and spacing member of the present invention in use with a plurality of rolls of web material.
Figure 5:
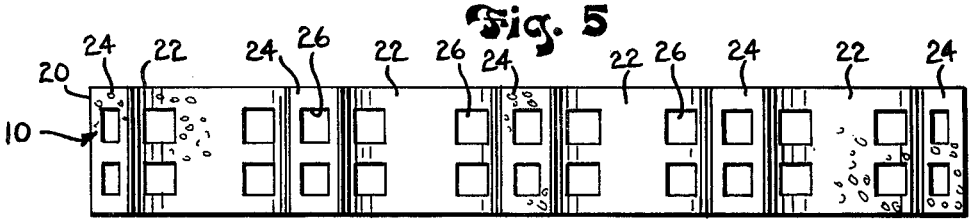
FIG. 5 is a top view of the supporting and spacing member of the present invention showing further details thereof.

As shown in FIGS. 3, 4 and 5, member 10 contains a plurality of recesses 26 in lands 24, and in indentations 22. Recesses 26 further serve to provide the necessary flexural properties to member 10.

In use, two or more supporting and spacing members 10 having indentations on only one side of bar 20 are placed at spaced locations on the top of pallet 14. The rolls 12 are then placed in the aligned indentations 22 of members 10 to form lowermost layer **12*a*. A single, long roll may be placed in each set of aligned indentations, or two or more shorter rolls may be so placed, as shown in FIG. 1. While a layer is shown as comprised of eight rolls in the FIGURES, it will be appreciated that a greater or smaller number of rolls and corresponding indentations in members 10 may be provided depending on the size of rolls 12, the size of pallet 14**, and other considerations.

Two or more supporting and spacing members 10 having indentations 22 on both sides of bar 20 are then laid on top of the rolls of layer **12*a* and the rolls of layer 12*b* placed in the exposed indentations. The process is then repeated until the desired number of intermediate layers are laid down. The stack is then capped with two or more supporting and spacing members 10 having indentations 20 on only one side of bar 20. The stack is fastened to pallet 14 by strapping 18 applied around members 10, edge strips 16 and pallet 14, as shown in FIG. 1** or the stack may be wrapped in a plastic packaging film to retain its integrity.

Figure 2:
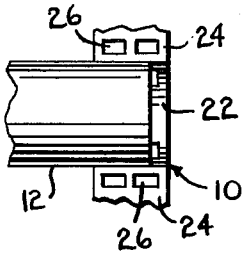
FIG. 2 is a fragmentary view taken generally along the line 2—2 of FIG. 1.

To provide the greatest degree of protection to the ends of rolls 12, the ends of all the rolls are spaced inwardly from the outer edges of members 10, as shown in FIG. 2, thereby avoiding any likelihood of nicks on the ends of the rolls.

Figure 7:
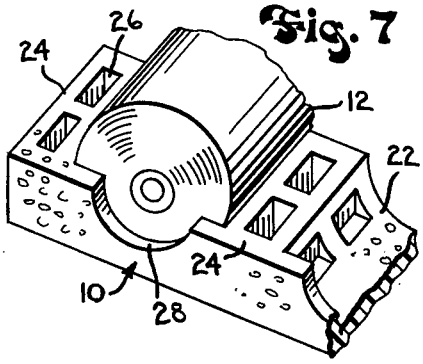
FIG. 7 is a fragmentary perspective view showing the embodiment of FIG. 6 in use with a roll of web material.

FIGS. 6 and 7 show a modified embodiment of the supporting and spacing member of the present invention in which a semi-circular lip 28 is provided along one side of indentations 22 to further improve the protective and retention properties of member 10. The use of lip 28 is particularly effective in protecting rolls 12 against radial end nicks which cause tearing of the web under tension.

Various modes of carrying out the invention are contemplated as being within the scope of the following claims particularly pointing out and distinctly claiming the subject matter which is regarded as the invention.

I claim:

1. A structure for protectively supporting and spacing rolls of web material in a multi-layer stack, comprising an elongated bar of expanded foam material having a pair of opposed surfaces, a first of said surfaces having a plurality of spaced parallel generally semi-cylindrical indentations disposed to receive rolls of web material, the radius of each of said semi-cylindrical indentations being greater than the depth of said indentation, whereby the rolls will be snuggly retained within indentations in a pair of said bars and the bars will be out of contact with each other, said bar having a plurality of recesses located in the side portions of said indentations to provide a greater flexural cushioning by said bars when clamped to said rolls.

2. The structure of claim 1, wherein the portions of said first surface disposed between said indentations constitute lands, said bar also having a plurality of recesses in said lands.

3. The structure of claim 1, wherein the bottom portions of the indentations are free of recesses.

4. The structure of claim 1, wherein the recesses extend only partially through the bar.

* * * * *